US006367401B1

(12) United States Patent
Correia et al.

(10) Patent No.: US 6,367,401 B1
(45) Date of Patent: Apr. 9, 2002

(54) SUBMARINE COUNTERMEASURE LAUNCHER WITH GAS CAPTURE

(75) Inventors: Ronald Correia, Fall River; John J. Silvera, Raynham, both of MA (US); Nicholas O. Venier, Tiverton, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 08/297,661

(22) Filed: Aug. 26, 1994

(51) Int. Cl.[7] ..... B23B 5/00

(52) U.S. Cl. ..... 114/238; 114/318

(58) Field of Search ..... 114/238, 316, 114/318, 319; 89/1.809, 5

(56) References Cited

U.S. PATENT DOCUMENTS 1,591,841 A * 7/1926 Kent ..... 114/238
1,656,249 A * 1/1928 Techel ..... 114/238
1,985,184 A * 12/1934 Methlin ..... 114/238

* cited by examiner

*Primary Examiner*—Sherman Basinger
(74) *Attorney, Agent, or Firm*—Michael J. McGowan; James M. Kasischke; Prithvi C. Lall

(57) ABSTRACT

A countermeasure launcher system, for use by a submarine, reducing any detectable signature by preventing the escape of pressurized gas into seawater at the forward end of the system's launch tube upon launching a countermeasure. The pressurized gas that is used in launching the countermeasure is trapped within the launch tube by a unique arrangement of specific components. The pressurized gas is then permitted to slowly exit at a later time via a pressure relief valve in the launch tube's wall.

2 Claims, 2 Drawing Sheets

SUBMARINE COUNTERMEASURE LAUNCHER WITH GAS CAPTURE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention generally relates to a system for reducing acoustic and visible signatures generated when a submarine countermeasure is launched. More particularly a submarine countermeasure launcher that generates gas to launch a countermeasure has the capacity to capture the gas and therefore reduce the signatures that could be used by an enemy for detection purposes. Countermeasure devices are used to protect submarines from attacking platforms by providing decoys.

(2) Description of the Prior Art

Ballistic missile submarines currently have eight countermeasure launch device ports positioned outside the submarine's pressure hull. They are located within the outer hull superstructure forward of the sail. These launch devices are each loaded with an individual countermeasure or another underwater instrument while the submarine is in port. The individual countermeasure or underwater instrument is launched at sea from the submarine's control room. The launch devices are expendable and cannot be reloaded while the submarine is at sea.

Prior to the present invention, the gas generated when firing a countermeasure puts large amounts of acoustic energy and gas bubbles into the water creating a significant detection risk from the resultant acoustic and visual observables.

SUMMARY OF THE INVENTION

Accordingly, it is a general purpose and object of the present invention to provide a system for making a countermeasure launcher more covert at time of launching. It is a further object to achieve this by inhibiting the gas generated during the firing from escaping the launch tube.

These objectives are accomplished with the present invention by providing a countermeasure launcher system design centered around capturing the launch tube ram piston at the end of its stroke in such a way that the bubbles produced by a gas generator are contained within the countermeasure launcher's launch tube. The captured bubbles can be released slowly with reduced acoustic effect.

BRIEF DESCRIPTION OF THE DRAWINGS

For a more complete understanding of the present invention and the advantages thereof, reference is now made to the following description of the preferred embodiment taken in conjunction with the accompanying drawings in which.

DESCRIPTION OF THE PREFERRED EMBODIMENT

Figure 1:
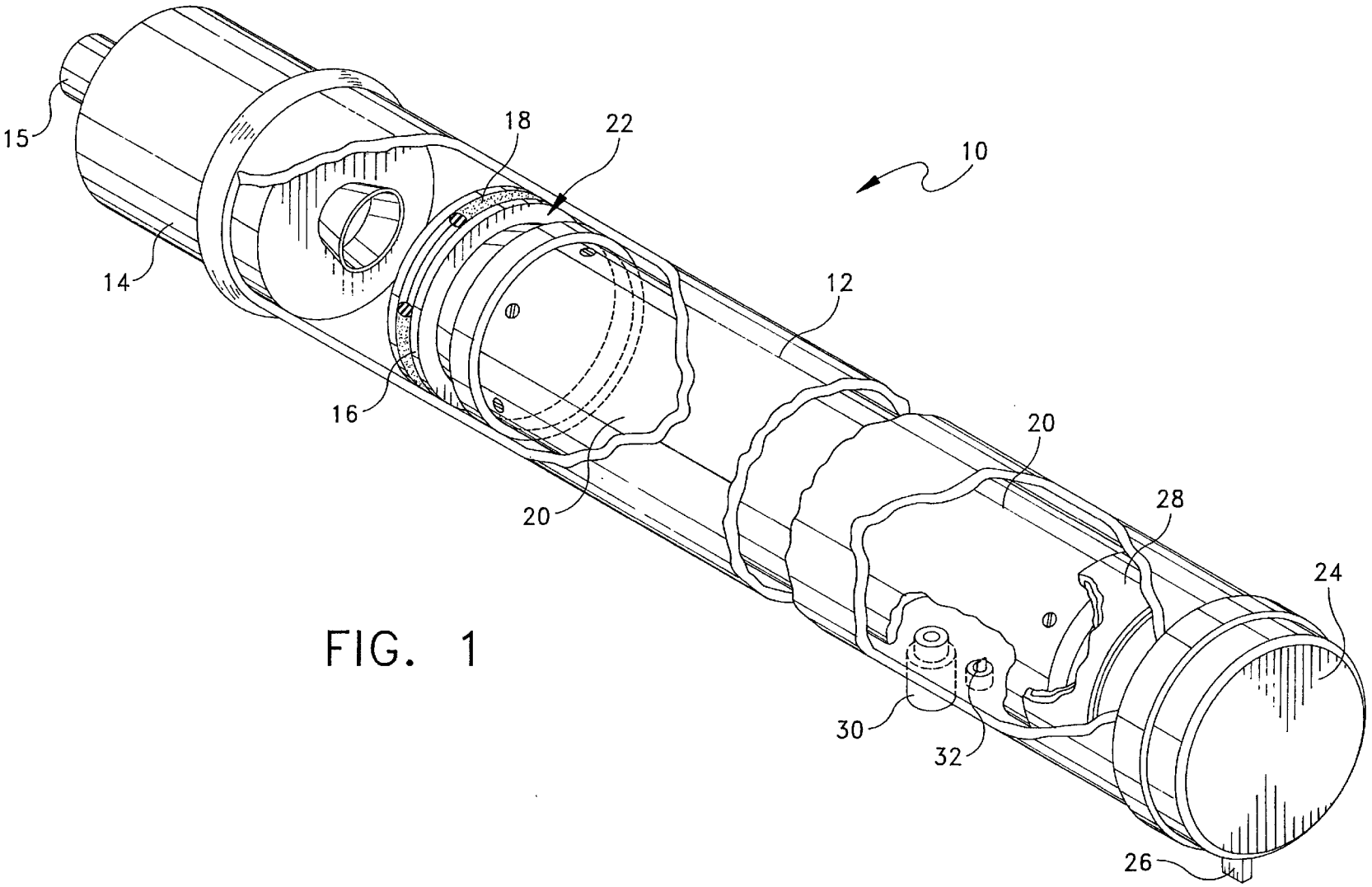
FIG. 1 is a partially cutaway pictorial representation of a countermeasure launcher in accordance with the present invention.

Refer now to the FIG. 1 for a description of the operation of the system and the components required to carry out its operation. A countermeasure launcher 10 comprises a cylinder 12 with a gas generator 14 at the back end of the launcher device 10. An electrical connector 15 feeds into the back end of the gas generator 14. A ram plate 16 is disposed in front of the gas generator 14. The electrical connector 15 provides firing voltage to the gas generator 14. The edges of the ram plate 16 are sealed by an O-ring 18. A countermeasure 20 is disposed in launch cylinder 12 forward of ram plate 16. The rear of the countermeasure 20 is nested in a thrust plate 22 to protect countermeasure 20 from ram plate 16 upon firing. Countermeasure launcher 10 is sealed against the ocean by an end cap 24 held in place by one or more shear pins 26.

Upon issuance of a firing command, an electrical signal is sent to the countermeasure launcher 10, via electrical connector 15. This causes gas generator 14 in countermeasure launcher 10 to discharge a large quantity of gas, which creates a high pressure behind ram plate 16, thereby causing the ram plate 16 to move forward down launch cylinder 12 while pushing countermeasure 20 and thrust plate 22 before it. When countermeasure 20 contacts end cap 24, the one or more shear pins 26 break, and cap 24 is pushed away enabling countermeasure 20 to exit launch cylinder 12.

In the prior art, after discharge of the countermeasure 20, thrust plate 22 and ram plate 16 also exit launch cylinder 12. This causes the gas behind ram plate 16 to rapidly follow through the opening and to disperse into the seawater. This sudden gas discharge causes a great deal of both acoustic energy and visible turbulence. It is audible and visible to any enemy craft monitoring the area in which it occurs, and it compromises the position of a submarine discharging the countermeasure 20.

The present invention provides a countermeasure launcher with a greatly reduced acoustic and visual signature. It achieves this by blocking the escape route of the gasses and then discharging these gasses slowly over a period of time.

In order to achieve this a stop ring 28 is added to the launch device 10. Stop ring 28 is disposed near the outer end of the launch cylinder 12. A pressure relief valve 30 is positioned behind stop ring 28. The pressure relief valve 30 can be a disk valve or another valve having quiet operation. A spring plunger 32 retains the ram plate 16 and the thrust plate 22 forward of the pressure relief valve 30 after firing so that neither the ram plate 16 nor the thrust plate 22 inhibits the operation of the pressure relief valve 30. Spring plunger 32 also minimizes thrust plate 22 oscillations thereby reducing transmitted acoustic energy. Stop ring 28 is positioned in launch cylinder 12 so as to allow the external end of countermeasure 20 to be resting inside of the stop ring 28 prior to firing and to guide countermeasure 20 while exiting from launch cylinder 12 upon firing. Countermeasure 20 has a slightly smaller outer diameter than the inner diameter of stop ring 28 allowing countermeasure 20 to exit upon launch. Thrust plate 22 has a diameter larger than the inner diameter of stop ring 28 so that it is prevented from exiting upon launch.

Figure 2:
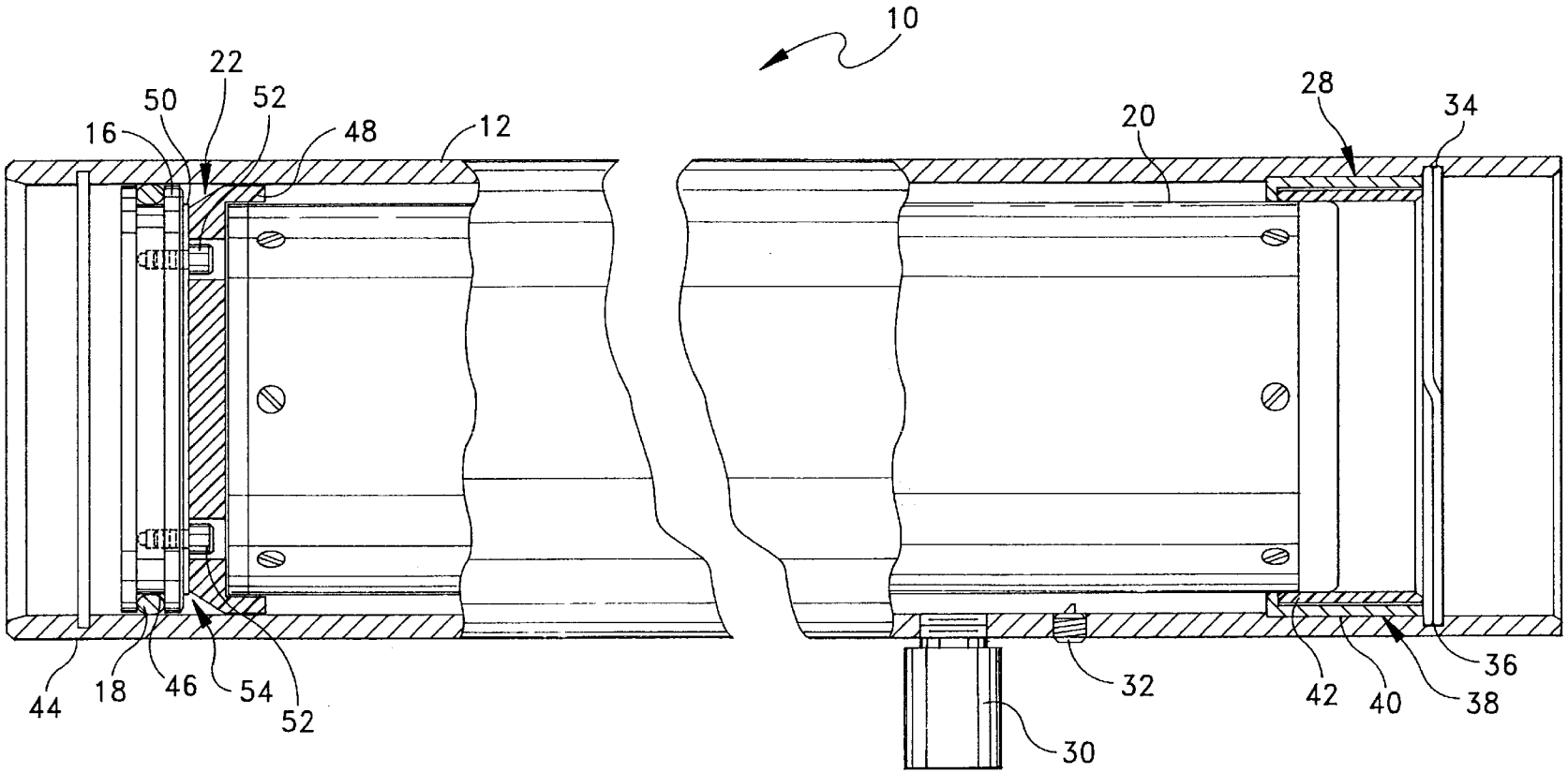
FIG. 2 shows a partial sectional view of the launcher tube of FIG. 1 and the components within it prior to launch.

Refer now to FIG. 2 for a further description of many of the components of FIG. 1. FIG. 2 shows a partial sectional view of launch cylinder 12 and the components within it. End cap 24, shear pins 26, gas generator 14, and electrical connector 15 have been removed from the launch cylinder 12 and are not shown in this view.

At the forward end of the launch cylinder 12 is shown the stop ring 28 that is comprised of a spiral retaining ring 34 inserted in a launch cylinder annular groove 36. In addition the stop ring 28 is made up of a stop/guide ring assembly 38, having a metallic stop ring 40 and a urethane guide ring 42 bonded together. The guide ring 42 has the countermeasure 20 resting inside it prior to launch and assists in guiding the countermeasure 20 during launch. The stop ring 40 stops the thrust plate 22 and the ram plate 16 upon launching the countermeasure 20. During launch, thrust plate 22 and ram plate 16 move past spring plunger 32 by causing plunger 32 to depress. Once thrust plate 22 and ram plate 16 move past plunger 32, plunger 32 returns to its initial position preventing plates 16 and 22 from vibrating because of recoil off of stop ring 28. This enables the pressure relief valve 30 to be clear of internal components when slowly discharging the contained gas.

The gas generator 14 of FIG. 1 is attached to threads 44 positioned on the outer side of the aft end of the launch cylinder 12. The inner portion of the aft end of the launch cylinder 12, shown prior to launch, has the ram plate 16 and thrust plate 22. The ram plate 16 has an annular groove 46 holding the O-ring 18. The thrust plate 22 is an assembly made up of a urethane guide ring 48 bonded to a thrust plate stop ring 50. Four equally spaced cap screws 52 connect the thrust plate 22 to the ram plate 16 forming a ram/thrust plate assembly 54.

The launching operation of the inventive device differs from that of the prior art in the following manner. Instead of leaving the launch cylinder 12, as in the prior art, the ram plate 16 and thrust plate 22 are retained by stop ring 28. In addition the ram plate 16 and the thrust plate 22 are held between the stop ring 28 and the spring plunger 32. The pressure relief valve 30 opens due to the pressure contained within the cylinder 12. Upon opening pressure relief valve 30 slowly bleeds the trapped, compressed gas into the surrounding ocean.

There has therefore been described a system for launching a countermeasure with considerably less noise than the former embodiment due to the elimination of suddenly discharged gasses that create noise.

Valve 30 can be positioned at any location having access to the high pressure gasses contained within the cylinder. For example, valve 30 can be embodied in the ram portion of the countermeasure. This alternative allows the improved countermeasure launcher to be installed in existing submarines and prevents the necessity of aligning the pressure relief valve with a submarine pressure exit port upon installation aboard the submarine. The valve also can embodied anywhere along the length of the cylinder.

Different types of valves can also be used for valve 30 in place of the pressure activated disk valve of the preferred embodiment. Valve 30 can be an electrically actuated valve that will allow release of the high pressure gasses on command rather than automatically as in the preferred embodiment.

Alternate means of retaining the ram also exist. One possible retaining means is by use of a retaining cable attached to the back end of the launch tube and the back end of the ram. This alternative also prevents the ram from exiting the launch tube.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A submarine countermeasure launcher with gas capture comprising:

a launch cylinder having a forward and an aft end;

a stop ring inserted within and affixed to said launch cylinder in the vicinity of said forward end;

a gas generator connected to said aft end of said launch cylinder for generating a gas to provide a gaseous pressure in said launch cylinder;

a ram/thrust plate assembly having a thrust plate on the forward side thereof inserted within said launch cylinder forward of said gas generator, said ram/thrust plate assembly further comprises an outer diameter larger than the inner diameter of said stop ring so that said stop ring prevents said ram/thrust plate assembly from exiting the forward end of said launch cylinder, said ram/thrust plate assembly further comprises an outer O-ring seal with said launch cylinder for preventing the gas from said gas generator from exiting the forward end of said launch cylinder;

a countermeasure inserted within said launch cylinder and having its rear portion nested in the thrust plate of said ram/thrust plate assembly, said countermeasure further comprises an outer diameter smaller than the inner diameter of said stop ring and said countermeasure having its forward portion inserted within said stop ring so as not to be inhibited by said stop ring when traveling in the forward direction within said launch cylinder;

a pressure relief valve located through a wall of said launch cylinder aft of said stop ring for bleeding said generated gas from inside to outside said countermeasure launcher following the launch of said countermeasure; and a spring plunger connected to said launch cylinder between said stop ring and said pressure relief valve, said spring plunger permitting said ram/thrust plate assembly to travel over said spring plunger in the forward direction within said launch cylinder and to prevent said ram/thrust plate assembly from passing over said spring plunger in the aft direction.

2. A submarine countermeasure launcher with gas capture according to claim 1 further comprising an end cap affixed to said forward end of said launch cylinder.

* * * * *